US010666023B2

(12) United States Patent
Gozawa

(10) Patent No.: US 10,666,023 B2
(45) Date of Patent: May 26, 2020

(54) SPARK PLUG

(71) Applicant: NGK SPARK PLUG CO., LTD., Nagoya-shi, Aichi (JP)

(72) Inventor: Tatsuya Gozawa, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/455,939

(22) Filed: Jun. 28, 2019

(65) Prior Publication Data

US 2020/0014175 A1 Jan. 9, 2020

(30) Foreign Application Priority Data

Jul. 3, 2018 (JP) ..... 2018-126571
Aug. 27, 2018 (JP) ..... 2018-158068

(51) Int. Cl.
*H01T 13/00* (2006.01)
*H01T 13/32* (2006.01)
*H01T 13/54* (2006.01)

(52) U.S. Cl.
CPC ..... *H01T 13/32* (2013.01); *H01T 13/54* (2013.01)

(58) Field of Classification Search
None
See application file for complete search history.

(56) References Cited

U.S. PATENT DOCUMENTS

2012/0125287 A1* 5/2012 Chiera ..... F02B 19/12 123/254
2015/0194793 A1 7/2015 Yamanaka

FOREIGN PATENT DOCUMENTS

JP 2007-040174 A 2/2007
JP 2015-130302 A 7/2015

* cited by examiner

*Primary Examiner* — Vip Patel
(74) *Attorney, Agent, or Firm* — Kusner & Jaffe

(57) ABSTRACT

A spark plug includes: a center electrode; an insulating member; a metal shell; a ground electrode; and a cap covers an opening of the metal shell on the front end side to define an auxiliary combustion space in which the gap is disposed, a first angle being formed by a second line and a first tangent line, a second angle being formed by the second line and a second tangent line, the second angle being greater than the first angle, and at least a portion of the opening of the specific through hole on the auxiliary combustion space side being positioned on a range of the second angle.

4 Claims, 6 Drawing Sheets

SPARK PLUG

FIELD OF THE INVENTION

The present invention relates to a spark plug.

BACKGROUND OF THE INVENTION

Conventionally, a spark plug is used in an internal combustion engine such as a gasoline engine and a gas engine. For example, Japanese Patent Application Publication No. 2015-130302 (corresponding to U.S. Patent Application Publication No. 2015/194793) discloses a spark plug including an auxiliary combustion chamber. In this spark plug, the auxiliary combustion chamber is formed in a cap fixed to a front end portion of a metal shell. The cap includes a hole connecting the auxiliary combustion space and the outside. The fuel gas is introduced through the hole of the cap into the auxiliary combustion chamber. Moreover, a center electrode and a ground electrode are disposed within the auxiliary combustion space. Spark generated in a gap between the center electrode and the ground electrode ignites the fuel gas introduced into the auxiliary combustion space. Then, the flame is discharged through the hole of the cap to the outside, that is, to the combustion chamber of the internal combustion engine, so that the fuel gas within the combustion chamber is combusted.

However, the above-described art is not sufficiently designed for the pressure loss and the heat loss which are generated within the auxiliary combustion space. Accordingly, the pressure loss and the heat loss which are generated within the auxiliary combustion space are excessively increased, so that it may not be possible to obtain the sufficient ignition performance (for example, stability of the combustion).

An advantage of the present invention is a spark plug which includes an auxiliary combustion space, and which is designed to solve the above-mentioned problems, and to improve the ignition performance.

SUMMARY OF THE INVENTION

According to one aspect of the present invention, there is provided a spark plug which comprises: a center electrode extending in a direction of an axis, and including a first discharge surface; an insulating member including an axial hole which extends in the direction of the axis, and which includes a front end portion to which the center electrode is disposed; a metal shell which has a cylindrical shape, and which is disposed radially outside the insulating member; a ground electrode including a second discharge surface which confronts the first discharge surface in the direction of the axis, and which forms a gap between the first discharge surface and the second discharge surface; and a cap that is connected to a front end portion of the metal shell, and that covers an opening of the metal shell on the front end side to define an auxiliary combustion space in which the gap is disposed, the cap including at least one through hole connecting the auxiliary combustion space and an outside, a first line, a specific point, a first tangent line, a second tangent line, and a second line being defined in a section including a center of gravity of an opening of a specific through hole of the at least one through hole on the auxiliary combustion space side, and the axis, the first line that passes through a center of a range which is perpendicular to the axis, and in which the first discharge surface and the second discharge surface exist, and that is parallel to the axis, the specific point being a middle point of a line connecting an intersection point between the first line and the first discharge surface, and an intersection point between the first line and the second discharge surface, the first tangent line being a half line which extends from the specific point, and which is tangent to the center electrode on the specific through hole side of the first line, the second tangent line being a half line which extends from the specific point, and which is tangent to the ground electrode on the specific through hole side of the first line, the second line being a half line which extends toward the specific through hole side of the first line, and which is perpendicular to the axis, a first angle being formed by the second line and the first tangent line, a second angle being formed by the second line and the second tangent line, the second angle being greater than the first angle, and at least a portion of the opening of the specific through hole on the auxiliary combustion space side being positioned on a range of the second angle.

DETAILED DESCRIPTION OF THE INVENTION

1. First Embodiment

1-1. Configuration of Spark Plug

Figure 1:
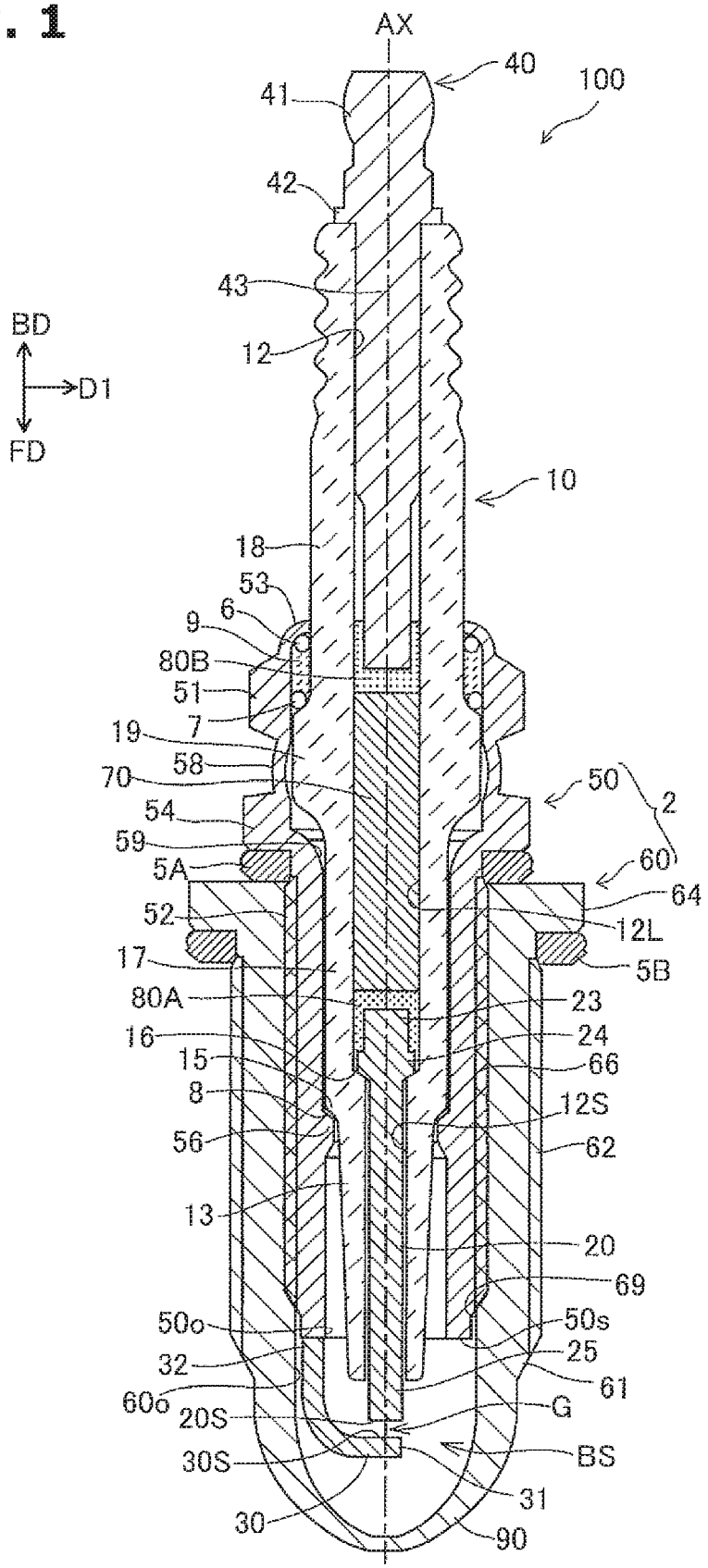
FIG. 1 is a sectional view showing a spark plug 100 according to an embodiment of the present invention.

FIG. 1 is a sectional view showing a spark plug 100 according to a first embodiment. A direction (upward and downward directions of FIG. 1) parallel to an axis AX is also referred to as an axial direction. A radial direction of a circle around the axis AX on a surface perpendicular to the axis AX is merely referred to as a radial direction. A downward direction in FIG. 1 is referred to as a front (tip) end direction FD. An upward direction in FIG. 1 is referred to as a rear end direction BD. A lower side in FIG. 1 is referred to as a front (tip) end side of the spark plug 100. An upper side in FIG. 1 is referred to as a rear end side of the spark plug 100.

The spark plug 100 is mounted to the internal combustion engine, as described above. The spark plug 100 is used for igniting fuel gas within a combustion chamber of the internal combustion engine. The spark plug 100 includes an insulating member 10; a center electrode 20; a ground (grounding) electrode 30; a terminal electrode 40; a metal shell 2 including an inside metal shell 50 and an outside metal shell 60; a resistance member 70; conductive seal members 80A and 80B; and a cap 90.

The insulating member 10 extends along the axis AX. The insulating member 10 is a substantially cylindrical member including an axial hole 12 which is a through hole penetrating through the insulating member 10. The insulating member 10 is made, for example, from ceramics such as alumina. The insulating member 10 includes a collar portion or protruding portion 19; a rear end side cylindrical portion 18; a front end side cylindrical portion 17; a decreasing outside diameter portion 15; and a long foot portion 13.

The collar portion 19 is a portion of the insulating portion 10 which is positioned at a substantially central position of the insulating member 10 in the axial direction. The rear end side cylindrical portion 18 is positioned on the rear end side of the collar portion 19. The rear end side cylindrical portion 18 has an outside diameter smaller than an outside diameter of the collar portion 19. The front end side cylindrical portion 17 is positioned on the front end side of the collar portion 19. The front end side cylindrical portion 17 has an outside diameter smaller than the outside diameter of the rear end side cylindrical portion 18. The long foot portion 13 is positioned on the front end side of the front end side cylindrical portion 17. The long foot portion 13 has an outside diameter smaller than the outside diameter of the front end side cylindrical portion 17. The diameter of the long foot portion 13 is smaller (decreased) toward the front end side. The long foot portion 13 includes a front end portion protruding beyond a front end surface of the inside metal shell 50 toward the front end side. The decreasing outside diameter portion 15 is formed between the long foot portion 13 and the front end side cylindrical portion 17. The decreasing outside diameter portion 15 has an outside diameter which is smaller (decreased) from the rear end side toward the front end side.

In an inner circumference side of the insulating member 10, the insulating member 10 includes a large inside diameter portion 12L positioned on the rear end side; a small inside diameter portion 12S which is positioned on the front end side of the large inside diameter portion 12L, and which has an inside diameter smaller than an inside diameter of the large inside diameter portion 12L; and a decreasing inside diameter portion 16. The decreasing inside diameter portion 16 is formed between the large inside diameter portion 12L and the small inside diameter portion 12S. The decreasing inside diameter portion 16 has inside diameters decreased from the rear end side toward the front end side. In this embodiment, the decreasing inside diameter portion 16 is positioned at an axial position corresponding to the front end portion of the front end side cylindrical portion 17.

The inside metal shell 50 is made from conductive metal (for example, low carbon steel). The inside metal shell 50 has a cylindrical shape. The inside metal shell 50 includes a through hole 59 penetrating through the inside metal shell 50 in the axial direction AX. The inside metal shell 50 is disposed radially outside the insulating member 10. That is, the insulating member 10 is inserted and held in the through hole 59 of the inside metal shell 50. The front end of the insulating member 10 protrudes beyond the front end of the inside metal shell 50 toward the front end side. A rear end of the insulating member 10 protrudes beyond the rear end of the inside metal shell 50 toward the rear end side.

The inside metal shell 50 includes a tool engaging portion 51 which has a hexagonal cylinder shape, and on which a plug wrench is engaged; a mounting screw portion 52 to which an external screw is formed for mounting the inside metal shell 50 to the outside metal shell 60; and a seat portion 54 which as a collar shape (protruding shape), and which is formed between the tool engaging portion 51 and the mounting screw portion 52. A nominal diameter of the mounting screw portion 52 is, for example, M8 to M14.

An inside gasket 5A is inserted and mounted between the mounting screw portion 52 and the seat portion 54 of the inside metal shell 50. The inside gasket 5A is made from metal. The inside gasket 5A has an annular shape. The inside gasket 5A seals a clearance between a seat portion 64 (described later) of the outside metal shell 60, and the seat portion 54 of the inside metal shell 50.

Moreover, the inside metal shell 50 includes a swaging portion 53 which has a thin shape, and which is provided on the rear end side of the tool engaging portion 51; and a compression deformation portion 58 which has a thin shape, and which is provided between the seat portion 54 and the tool engaging portion 51. Annular line packings 6 and 7 are disposed in an annular region formed between an inner circumference surface of the inside metal shell 50 from the tool engaging portion 51 to the swaging portion 53, and an outer circumference of the rear end side cylindrical portion 18 of the insulating member 10. Powder of talc 9 is filled between the line pacing 6 and 7 in the above-described region. A rear end of the swaging portion 53 is bent in a radially inward direction, and fixed to the outer circumference surface of the insulating member 10. At the manufacturing operation, the swaging portion 53 fixed to the outer circumference surface of the insulating member 10 is pressed toward the front end side, so that the compression deformation portion 58 of the inside metal shell 50 is compressed and deformed. The insulating member 10 is pressed within the inside metal shell 58 through the line packings 6 and 7 and the talc 9 toward the front end side, by the compression and the deformation of the compression deformation portion 58. The decreasing outside diameter portion 15 (insulating member side stepped portion) of the insulating member 10 is pressed through an annular plate packing 8 by a stepped portion 56 (metal shell side stepped portion) formed on the inner circumference of the inside metal shell 50 at the position of the mounting screw portion 52. With this, the plate packing 8 prevents the leakage of the gas within the combustion chamber of the internal combustion engine from the clearance between the inside metal shell 50 and the insulating member 10 to the outside.

The outside metal shell 60 has a cylindrical shape. The outside metal shell 60 is made from conductive metal identical to that of the inside metal shell 50. The outside metal shell 50 includes a through hole 69 penetrating through the outside metal shell 50 along the axis AX. The outside metal shell 60 is disposed radially outside the inside metal shell 50 on the front end side of the seat portion 54 of the inside metal shell 50. The outside metal shell 60 includes an internal screw 66 formed on an inner circumference surface of the outside metal shell 60. The external screw formed on the mounting screw portion 52 of the inside metal shell 50 is engaged with the internal screw 66. With this, a portion of the inside metal shell 50 which is located on the front end side of the seat portion 54 is inserted and held within the through hole 69 of the outside metal shell 60.

The outside metal shell 60 includes a mounting screw portion 62; a seat portion 64 located on the rear end side of the mounting screw portion 62. A nominal diameter of the mounting screw portion 62 is, for example, M10 to M18. The mounting screw portion 62 includes an external screw which is formed on an outer circumference surface of the mounting screw portion 62, and which is for fixing the spark plug 100 to an engine head (not shown) of the internal combustion engine.

An outside gasket 5B is inserted and mounted between the mounting screw portion 62 and the seat portion 64 of the outside metal shell 60. The outside gasket 5B is made from metal. The outside gasket 5B has an annular shape. The outside gasket 5B seals a clearance between the spark plug 100 and the internal combustion engine (the engine head) when the spark plug 100 is mounted to the internal combustion engine.

A cap 90 is formed at the front end portion 61 of the outside metal shell 60. The cap 9 covers openings 60*o* and 50*o* of the outside metal shell 60 and the inside metal shell 50 which are located on the front end side. Configurations of the cap 90 are described later. The cap 90 defines and forms an auxiliary combustion region BS in which a gap G (described later) is disposed.

The cap 90 is made from metal having high corrosion resistance and high thermal resistance, for example, nickel (Ni) or nickel-based alloy (for example, NCF600, NCF601), tungsten. In this embodiment, the outside metal shell 60 is made from the Ni alloy. The cap 90 is integrally formed with the outside metal shell 60. Alternatively, the cap 90 may be made from a member different from the outside metal shell 60. The cap 90 may be jointed to the front end of the outside metal shell 60 by the welding.

The center electrode 20 is a rod-shaped member extending along the axis AX. The center electrode 20 is made from the metal having the high corrosion resistance and the high thermal resistance, for example, the nickel (Ni) or the nickel-based alloy (for example, NCF600, NCF601). The center electrode 20 may have a two-layered structure having base metal made from Ni or Ni alloy, and a core portion embedded within the base metal. In this case, the core portion is made from cupper having a thermal conductivity higher than that of the base metal, and the cupper-based alloy. The center electrode 20 is held at a portion on the front end side of the inside of the axial hole 12. That is, the rear end side of the center electrode 20 is disposed within the axial hole 12. A surface of a foot portion 25 on the front end side is a first discharge surface 20S. A gap G is formed between the first discharge surface 20S and a second discharge surface 30S of the ground electrode 30 described later.

As shown in FIG. 1, the center electrode 20 includes a flange portion 24 provided at a predetermined axial position; a head portion 23 (electrode head portion) which is positioned on the rear end side of the flange portion 24; and the foot portion 25 (electrode foot portion) which is positioned on the front end side of the flange portion 24. The flange portion 24 is supported from the front end side by the decreasing inside diameter portion 16 of the insulating member 10. That is, the center electrode 20 is retained on the decreasing inside diameter portion 16. In this way, the rear end side of the center electrode 20 is disposed within the axial hole 12 (the small inside diameter portion 12S).

The terminal electrode 40 is a rod-shaped member extending in the axial direction. The terminal electrode 40 is inserted from the rear end side into the axial hole 12 of the insulating member 10. The terminal electrode 40 is positioned within the axial hole 12 on the rear end side of the center electrode 20. The terminal electrode 40 is made from conductive metal (for example, low-carbon metal). For example, the Ni plating for the corrosion protection is formed on the surface of the terminal electrode 40.

The terminal electrode 40 includes a flange portion 42 (terminal jaw portion) formed at a predetermined axial position; a cap mounting portion 41 positioned on the rear end side of the flange portion 42; and a foot portion 43 (terminal foot portion) positioned on the front end side of the flange portion 42. The cap mounting portion 41 of the terminal electrode 40 is exposed from the insulating member 10 to the rear end side. The foot portion 43 of the terminal electrode 40 is inserted into the axial hole 12 of the insulating member 10. A plug cap is mounted on the cap mounting portion 41. The plug cap is connected to a high voltage cable (not shown). The high voltage is applied to the cap mounting portion 41 for generating the electric discharge.

The resistance member 70 is disposed within the axial hole 12 of the insulating member 10 between the front end of the terminal electrode 40 and the rear end of the center electrode 20. The resistance member 70 has a resistance value of, for example, 1KΩ or more (for example, 5KΩ). The resistance member 70 has a function to decrease the radio wave noise at the generation of the spark. The resistance member 70 is made, for example, from constituent (composite) including glass particles of main components, the ceramic particles other than the glass, and the conductive material.

A conductive seal member 80A is embedded in a clearance between the resistance member 70 and the center electrode 20 within the axial hole 12. A conductive seal member 80B is embedded in a clearance between the resistance member 70 and the terminal electrode 40. That is, the seal member 80A is abutted on the center electrode 20 and the resistance member 70. The seal member 80A separates the center electrode 20 and the resistance member 70. The seal member 80B is abutted on the resistance member 70 and the terminal electrode 40. The seal member 80B separates the resistance member 70 and the terminal electrode 40. In this way, the seal members 80A and 80B electrically and physically connect the center electrode 20 and the terminal electrode 40 through the resistance member 70. The seal members 80A and 80B are made from conductive material, for example, constituent (composite) including glass particle such as $B_2O_3$—$SiO_2$ and metal particle (Cu, Fe and so on).

The ground electrode 30 is a rod-shaped member having a rectangular section, as shown in FIG. 1. The ground electrode 30 includes a connection end portion 32 located on a first end side; and a free end portion 31 located on a second end side opposite to the first end side. The connection end portion 32 is jointed to the front end portion 50*s* of the inside metal shell 50 by, for example, the resistance welding. With this, the metal shell 2 (the inside metal shell 50 and the outside metal shell 60) and the ground electrode 30 are electrically and physically connected to each other. A portion near the connection terminal 32 of the ground electrode 30 extends in the direction of the axis AX. A portion near the free end portion 31 extends perpendicularly to the direction of the axis AX. The rod-shaped ground electrode 30 is curved at a central portion by substantially 90 degrees.

The ground electrode 30 is made from the metal having the high corrosion resistance and the high thermal resistance, for example, the nickel (Ni) or the nickel-based alloy (for example, NCF600, NCF601). Similarly to the center electrode 20, the ground electrode 30 may have a two-layered structure having base metal, and a core portion made from metal (for example, cupper) having thermal conductivity higher than that of the base metal, and embedded within the base metal. A side surface directing toward the rear end side of the free end portion 31 is the second discharge surface 30S. The gap G is formed between the second discharge surface 30S and the first discharge surface 20S of the center electrode 20. The first discharge surface 20S and the second discharge surface 30S confront each other in the direction of the axis AX. The gap G is a spark gap within which the electric discharge is generated.

Figure 2:
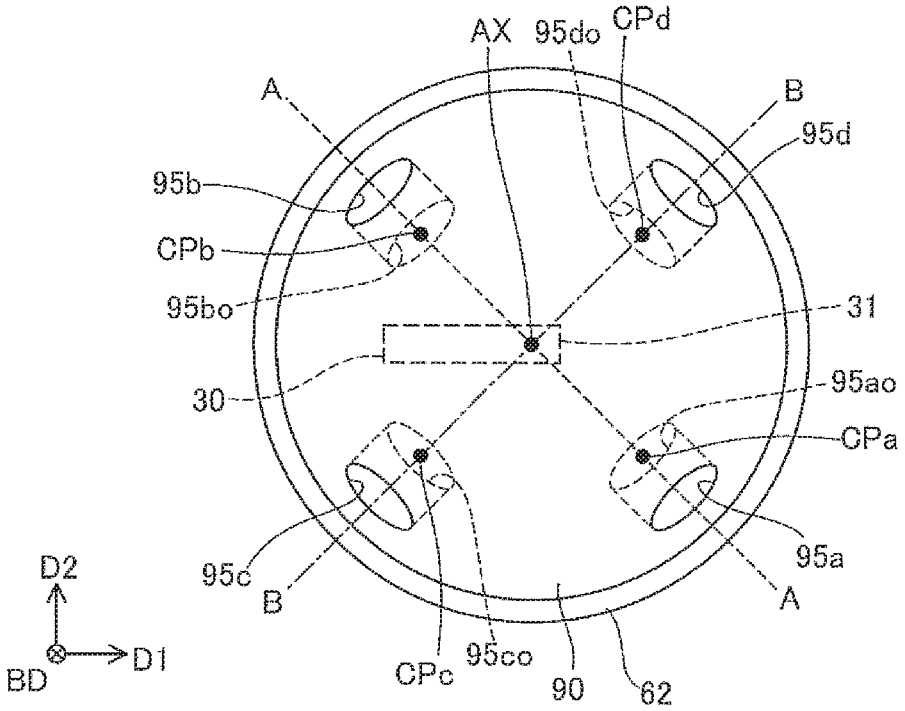
FIG. 2 is a view showing a front end portion of the spark plug 100 when viewed along an axial line AX from a front end side toward a rear end direction BD.

FIG. 2 is a view showing a portion near the spark plug 100 when viewed in the direction of the axis AX from the front end side to the rear end direction BD. The cap 90 includes a plurality of through holes 95*a* to 95*d* (four through holes in the example in FIG. 2) connecting the auxiliary combustion space BS and the outside. The four through holes 95*a* to 95*d* are disposed at intervals in the circumferential direction. FIG. 2 shows centers CPa to CPd of gravity of openings 95*ao* to 95*do* of the four through holes 95*a* to 95*d* on the auxiliary combustion space BS side.

A first direction D1 is defined in FIG. 2 by a direction in which the free end portion 31 of the ground electrode 30 extends to pass through the axis AX. Moreover, a second direction D1 is defined in FIG. 2 by a direction (upward direction in FIG. 2) perpendicular to the first direction D1. The four through holes 95*a* to 95*d* are disposed at circumferential positions to form 45 degrees with respect to the first direction D1 and the second direction D2. Therefore, the four through holes 95*a* to 95*d* are not represented in FIG. 1.

Figure 3:
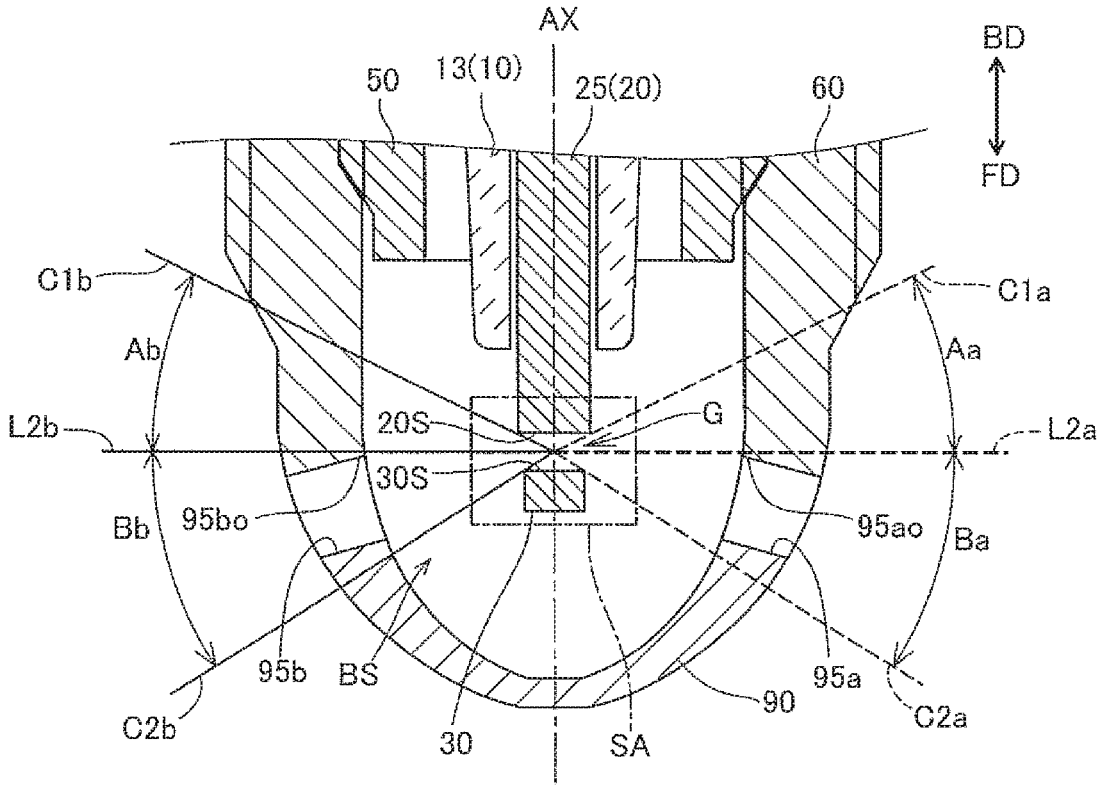
FIG. 3 is a view showing a section CF1 taken along a surface represented by a broke line A-A of FIG. 2, and obtained by cutting the front end portion of the spark plug 100.

FIG. 3 shows a section CF1 taken along a broken line A-A of FIG. 2, and obtained by cutting a portion near the front end of the spark plug 100. The surface shown by the broken line A-A of FIG. 2 is a surface having the axis AX, the center CPa of gravity of the opening 95*ao* of the through hole 95*a* on the auxiliary combustion space BS side, and the center CPb of gravity of the opening 95*bo* of the through hole 95*b* on the auxiliary combustion space BS side.

As shown in FIG. 3, the cap 90 is a hollow member having a substantially hemisphere shape. Accordingly, the auxiliary combustion space BS has a substantially hemisphere shape. The front end side portion of the long foot portion 13, the ground electrode 30, and the front end side portion of the center electrode 20 are disposed within the auxiliary combustion space BS. The gap G is disposed in the auxiliary combustion space BS.

In this embodiment, as shown in FIG. 2 and FIG. 3, the through hole is not formed at position intersected to the axis AX in the cap 90. The axial positions of the four through holes 95*a* to 95*d* are substantially identical to the axial positions at which the free end portion 31 of the ground electrode 30 and the gap G are positioned.

Figure 4:
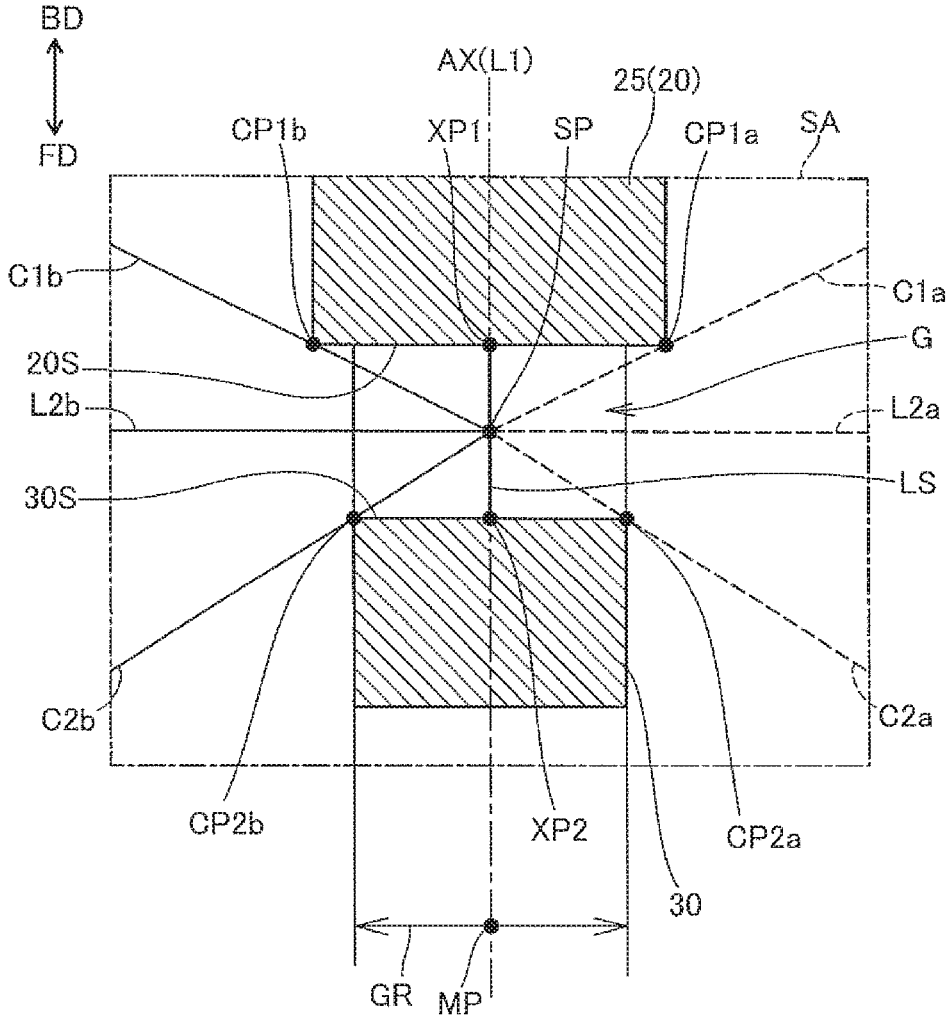
FIG. 4 is a view obtained by enlarging a rectangular area SA shown in FIG. 3.

FIG. 4 is a view obtained by enlarging a rectangular region SA shown in FIG. 3. A lateral range in which the first discharge surface 20S of the center electrode 20 and the second discharge surface 30S of the ground electrode 30 exist in the section CF as shown in FIG. 4 is referred to as a discharge region GR. The lateral range in FIG. 4 is a range perpendicular to the axis AX. A range central line L1 is defined by a line which passes through a center point MP of the discharge region GR, and which is parallel to the axis AX. In this embodiment, the range central line L1 is aligned with the axis AX in the section CF1, as shown in FIG. 4. A specific point SP is defined as a middle point of a line LS connecting an intersection point XP1 between the range central line L1 and the first discharge surface CF1, and an intersection point XP2 between the range central line L1 and the second discharge surface 30S.

As to the position of the through hole 95*a*, three half lines shown by broken lines in FIG. 3 and FIG. 4 are defined. That is, a center electrode side tangent line C1*a*, a ground electrode side tangent line C2*a*, and a gap central line L2*a* are defined as shown in FIGS. 3 and 4. The center electrode side tangent line C1*a* is a half line which extends from the specific point SP, and which is tangent to the center electrode 20 on the through hole 95*a* side (the right side of FIGS. 3 and 4) of the range central line L1. The ground electrode side tangent line C2*a* is a half line which extends from the specific point SP, and which is tangent to the ground electrode 30 on the through hole 95*a* side (the right side of FIGS. 3 and 4) of the range central line L1. The gap central line L2*a* is a half line which extends from the specific point SP toward the through hole 95*a* side (the right side of FIGS. 3 and 4), and which is a perpendicular to the axis AX. In FIG. 4, a point CP1*a* is a contact point between the center electrode side tangent line C1*a* and the center electrode 20. A point CP2*a* is a contact point between the ground electrode side tangent line C2*a* and the ground electrode 30.

As shown in FIG. 3, a first angle Aa is formed by the center electrode side tangent line C1*a* and the gap central line L2*a* in the section CF1. A second angle Ba is formed by the ground electrode side tangent line C2*a* and the gap central line L2*a* in the section CF1. The second angle Ba is greater than the first angle Aa. The opening 95*ao* of the through hole 95*a* on the auxiliary combustion space BS side is located in the range of the second angle Ba. Moreover, the entire through hole 95*a* is located in the range of the second angle Ba in the section CF1.

Similarly, as to the position of the through hole 95*b*, three half lines shown by solid lines in FIGS. 3 and 4, specifically, a center electrode side tangent line C1*b*, a ground electrode side tangent line C2*b*, and a gap central line L2*b* are defined. The center electrode side tangent line C1*b* is a half line which extends from the specific point SP, and which is tangent to the center electrode 20 on through hole 95*b* side (the left side of FIGS. 3 and 4) of the range central line L1. The ground electrode side tangent line C2*b* is a half line which extends from the specific point SP, and which is tangent to the ground electrode 30 on the through hole 95*b* side (the left side of FIGS. 3 and 4) of the range central line L1. The gap central line L2*b* is a half line which extends from the specific point SP toward the through hole 95*b*, and which is perpendicular to the axis AX. In FIG. 4, a point CP1*b* is a contact point between the center electrode side tangent line C1*b* and the center electrode 20. A point CP2 is a contact point between the ground electrode side tangent line C2*b* and the ground electrode 30.

As shown in FIG. 3, a first angle Ab is formed by the center electrode side tangent line C1*b* and the gap central line L2*b* in the section CF1. A second angle Bb is formed by the ground electrode side tangent line C2*b* and the gap central line L2*b* in the section CF1. The second angle Bb is greater than the first angle Ab. The opening 95*bo* of the through hole 95*b* on the auxiliary combustion space BS side is located within the range of the second angle Bb. Moreover, the entire through hole 95*b* is located within the range of the second angle Bb in the section CF1.

Figure 5:
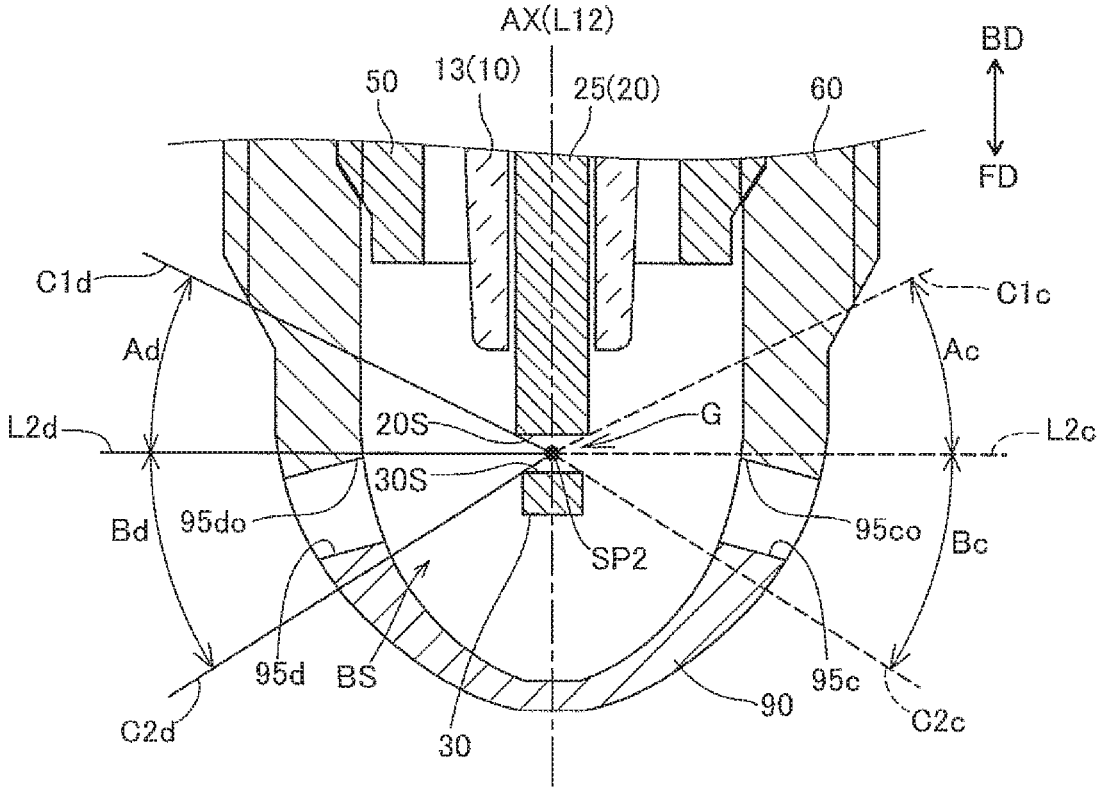
FIG. 5 is a view showing a section CF2 taken along a surface represented by a broke line B-B of FIG. 2, and obtained by cutting the front end portion of the spark plug 100.

FIG. 5 shows a section taken along a broken line B-B of FIG. 2, and obtained by cutting a portion near the front end of the spark plug 100. The surface shown by the broken line B-B of FIG. 2 is a surface including the axis AX, the center CPc of gravity of the opening 95*co* of the through hole 95*c* on the auxiliary combustion space BS side; and the center CPd of gravity of the opening 95*do* of the through hole 95*d* on the auxiliary combustion space BS side.

As shown in FIG. 5, the section CF2 satisfies a relationship identical to that in the section CF1 (FIG. 3). In particular, as to the position of the through hole 95*c*, three half lines shown by broken lines in FIG. 5, that is, a center electrode side tangent line C1*c*, a ground electrode side tangent line C2*c*, and a gap central line L2*c* are defined. The center electrode side tangent line C1*c* is a half line which extends from a specific point SP2, and which is tangent to the center electrode 20 on the through hole 95*c* side (the right side of FIG. 5) of the range central line L12. The ground electrode side tangent line C2*c* is a half line which extends from the specific point SP2, and which is tangent to the ground electrode 30 on the through hole 95*c* side (the right side of FIG. 5) of the range central line L12. The gap central line L2*c* is a half line which extends from the specific point SP2 toward the through hole 95*c* (the right side of FIG. 5), and which is perpendicular to the axis AX. In this case, the range central line L12 and the specific point SP2 are defined in the section CF2, similarly to the specific point SP and the range central line L1 in the section CF1 (FIG. 4). That is, the range central line L12 is a line which passes through a central point of a lateral range in which the first discharge surface 20S and the second discharge surface 30S exist in the section CF2, and which is parallel to the axis AX. In FIG. 5, the range central line L12 and the axis AX are aligned with each other. The specific point SP2 is a central point of a line connecting an intersection point between the range central line L12 and the first discharge surface 20S, and an intersection point between the range central line L12 and the second discharge surface 30S.

As shown in FIG. 5, a first angle Ac is formed by the center electrode side tangent line C1*c* and the gap central line L2*c* in the section CF2. A second angle Bc is formed by the ground electrode side tangent line C2*c* and the gap central line L2*c* in the section CF2. The second angle Bc is greater than the first angle Ac. The opening 95*co* of the through hole 95*c* on the auxiliary combustion space BS side is located in the range of the second angle Bc. Moreover, the entire through hole 95*c* is located in the range of the second angle Bc in the section CF.

Similarly, as to the positon of the through hole 95*d*, three half lines shown by solid lines in FIG. 5, specifically, a center electrode side tangent line C1*d*, a ground electrode side tangent C2*d*, and a gap central line L2*d* are defined. The center electrode side tangent line C1*d* is a half line which extends from the specific point SP2, and which is tangent to the center electrode 20 on the through hole 95*d* side (the left side of FIG. 5) of the range central line L12. The ground electrode side tangent line C2*d* is a half line which extends from the specific point SP2, and which is tangent to the ground electrode 30 on the through hole 95*d* side (the left side of FIG. 5) of the range central line L12. The gap central line L2*d* is a half line which extends from the specific point SP2 toward the through hole 95*d*, and which is perpendicular to the axis AX.

As shown in FIG. 5, a first angle Ad is formed in the section CF2 by the center electrode side tangent line C1*d* and the gap central line L2*d*. A second angle Bd is formed in the section CF2 by the ground electrode side tangent line C2*d* and the gap central line L2*d*. The second angle Bd is greater than the first angle Ad. The opening 95*d* of the through hole 95*d* on the auxiliary combustion space BS side is located within the range of the second angle Bd. Moreover, the entire through hole 95*d* is within the range of the second angle Bd in the section CF2.

The above-described spark plug 100 according to the embodiment is operated as follows. The spark plug 100 is mounted to and used in the internal combustion engine such as the gas engine. An ignition device (for example, full transistor ignition device) including a predetermined power source applies the voltage between the ground electrode 30 and the center electrode 20 of the spark plug 100. With this, the spark discharge is generated in the gap G between the ground electrode 30 and the center electrode 20. The fuel gas within the combustion chamber of the internal combustion engine flows through the through holes 95*a* to 95*d* of the cap 90 into the auxiliary combustion space BS. The fuel gas is ignited by the spark generated within the auxiliary combustion space BS. The flame generated by the combustion of the ignited fuel gas is discharged through the through holes 95*a* to 95*d* of the cap 90 to the outside (the combustion chamber of the internal combustion engine). The fuel gas within the combustion chamber of the internal combustion engine is ignited by the discharged flame. Consequently, it is possible to rapidly combust the entire fuel gas within the combustion chamber even in the internal combustion engine including the combustion chamber having the large volume.

In the above-described spark plug 100 according to the embodiment, the second angle Ba is greater than the first angle Aa in the section CF1 including the center CPa of the gravity of the opening 95*ao* of the through hole 95*a*, and the axis AX. Moreover, the through hole 95*a* and the opening 95*ao* are positioned in the range of the second angle Ba (cf. FIG. 3). Accordingly, the flame within the auxiliary combustion space BS is easy to be discharged through the opening 95*ao* of the through hole 95*a* beyond the spark plug 100 toward the front end side. Furthermore, the opening 95*ao* of the through hole 95*a* is positioned in the range of the second angle Ba. With this, it is possible to suppress the interruption of the flame which is enlarged from the spark generated in the gap G, and which is discharged from the through hole 95*a*, by the ground electrode 30. Consequently, it is possible to decrease the heat loss and the pressure loss which are generated by the contact of the flame with the ground electrode 30. Therefore, it is possible to improve the ignition performance.

Moreover, in the spark plug 100 according to the embodiment, the entire through hole 95*a* is positioned in the range of the sum of the first angle Aa and the second angle Ba in the section CF1. That is, in the section CF1, the rear end of the through hole 95*a* is positioned on the front end side of the center electrode side tangent line C1*a*. The front end of the through hole 95*a* is positioned on the rear end side of the ground electrode side tangent line C2*a* (cf. FIG. 3). Accordingly, it is possible to effectively suppress the interruption of the flame discharged from the through hole 95*a* by the ground electrode 30. Therefore, it is possible to further improve the ignition performance of the spark plug 100.

Furthermore, in the spark plug 100 according to the embodiment, in the section CF1, the entire through hole 95*a* is located in the range of the second angle Ba. That is, in the section CF1, the rear end of the through hole 95*a* is positioned on the front end side of the gap central line L2*a*. The front end of the through hole 95*a* is positioned on the rear end side of the ground electrode side tangent line C2*a* (cf. FIG. 3). Accordingly, the flame within the auxiliary combustion space BS is further easy to be discharged through the through hole 95*a* beyond the spark plug 100 toward the front end side. Therefore, it is possible to further improve the ignition performance of the spark plug 100.

Moreover, in the spark plug 100 according to the embodiment, the other through holes 95*b* to 95*d* satisfy the relationships identical to those of the through hole 95*a*. That is, in the section CF1, the second angle Bb is greater than the first angle Ab. The opening 95*bo* of the through hole 95*b* is positioned in the range of the second angle Bb (cf. FIG. 3). Furthermore, in the section CF2, the second angles Bc and Bd are, respectively, greater than the first angles Ac and Ad. The openings 95*co* and 95*do* of the through holes 95*c* and 95*d* are positioned, respectively, in the ranges of the second angles Bc and Bd (cf. FIG. 5). Accordingly, the flame within the auxiliary combustion space BS is easy to be discharged through the plurality of the through holes 95*a* to 95*d* beyond the spark plug 100 toward the front end side. Furthermore, it is possible to decrease the heat loss and the pressure loss which are generated due to the contact of the flame passing through the plurality of the through holes 95*a* to 95*d*, with the ground electrode 30. Therefore, it is possible to improve the ignition performance of the spark plug 100.

Furthermore, in the sections CF1 and CF2, the entire through holes 95*b* to 95*d* are positioned, respectively, in the sums of the first angles Ab, Ac, and Ad and the second angles Bb, Bc, and Bd. Accordingly, it is possible to suppress the interruption of the flame discharged from the through holes 95*b*, 95*c*, and 95*d* by the ground electrode 30.

Moreover, in the sections CF1 and CF2, the entire through hole 95*b*, 95*c*, and 95*d* are positioned, respectively, in the ranges of the second angles Bb, Bc, and Bd. Accordingly, the flame within the auxiliary combustion space BS is further easy to be discharged through the through holes 95*b*, 95*c*, and 95*d* beyond the spark plug 100 toward the front end side.

As understood from the above-explanations, the central side tangent lines C1*a* to C1*d* according to the embodiment are examples of a first tangent line. The ground electrode side tangent lines C2*a* to C2*d* are examples of a second tangent line. The range central lines L1 and L12 are examples of a first line. The gap central lines L2*a* to L2*d* are examples of a second line.

2. Variations (1) In the above-described embodiment, the entire through hole 95*a* is positioned in the range of the second angle Ba. In place of this, a portion of the through hole 95*a* may be positioned outside the range of the second angle Ba. For example, the front end of the through hole 95*a* may be positioned on the front end side of the ground electrode side tangent line C2*a*. The rear end of the through hole 95*a* may be positioned on the rear end side of the center electrode side tangent line C1*a*. However, it is preferable that at least a portion of the opening 95*ao* of the through hole 95*a* is positioned within the range of the second angle Ba. With this, it is possible to suppress the interruption of the flame discharged from the through hole 95*a* by the ground electrode 30. These are applicable to the other through holes 95*b* to 95*d*.

(2) The cap 90 may include the other through holes, in addition to the through holes 95*a* to 95*d*. For example, in the sections CF1 and CF2, the cap 90 may include the through hole whose the entire configuration is outside the second angles Ba to Bd. In particular, the cap 90 may include a through hole opened in the axis AX.

(3) In the cap 90 in the above-described embodiment, the plurality of the through holes 95*a* to 95*d* have different circumferential positions, the same axial position, the same radial position, the same shape, and the same size. In place of this, all or a part of the plurality of through holes 95*a* to 95*d* may have the different axial position, the different radial position, the different shape, and/or the different size.

Figure 6:
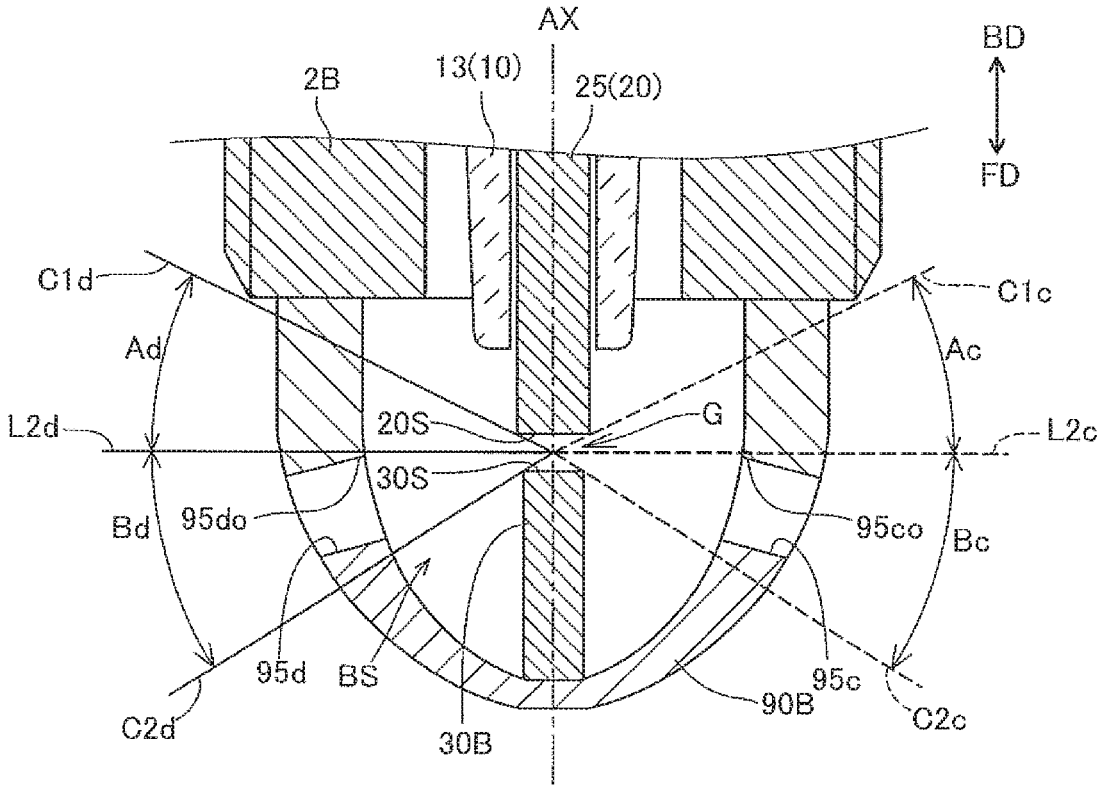
FIG. 6 is an explanation view showing a variation of the embodiment.

(4) The concrete configuration of the spark plug 100 according to the embodiment is one example. The present invention is not limited to this. FIG. 6 is an explanation view showing a variation. FIG. 6 shows a portion corresponding to the section CF2 according to the first embodiment of FIG. 1.

In this variation, a metal shell 2B is not divided to the two members. The metal shell 2B is constituted by one member. Moreover, in this variation, a cap 90B is fixed to a front end surface of the metal shell 2B by the welding. Moreover, in this variation, a ground electrode 30B is a cylindrical rod extending in the direction of the axis AX. A surface of the ground electrode 30B on the rear end side is a second discharge surface 30S. A surface of the ground electrode 30B on the front end side is jointed to an inner surface of the cap 90B by the welding. With this, the ground electrode 30B is electrically connected through the cap 90B to the metal shell 2B. The other structures of the spark plug in FIG. 6 are identical to those of the structures of the spark plug 100 according to the first embodiment.

In the embodiment, materials, shapes, sizes, and so on of the center electrode 20, the terminal electrode 40, the ground electrode 30, and so on may be varied. For example, in the above-described embodiment, each of the center electrode 20 and the ground electrode 30 is made from one material. In place of this, the center electrode may include a center electrode main body, and a center electrode tip which is welded to a front end of the center electrode main body, and which includes a discharge surface. Moreover, the ground electrode 30 may include a ground electrode main body, and a ground electrode tip which is welded to a free end portion of the ground electrode main body, and which includes a discharge surface. The center electrode tip and the ground electrode tip are made from materials (for example, noble metal such as iridium (Ir) and platinum (Pt), and tungsten (W), and alloy including at least one of these metals) which has durability with respect to the electric discharge, that is higher than that of the electrode main body (for example, Ni alloy).

A spark plug according to the embodiment of the present invention includes a center electrode (20) extending in a direction of an axis (AX), and including a first discharge surface (20S); an insulating member (10) including an axial hole (12) which extends in the direction of the axis (AX), and which includes a front end portion to which the center electrode (20) is disposed; a metal shell (2, 2B) which has a cylindrical shape, and which is disposed radially outside the insulating member (10); a ground electrode (30, 30B) including a second discharge surface (30S) which confronts the first discharge surface (20S) in the direction of the axis (AX), and which forms a gap (G) between the first discharge surface (20S) and the second discharge surface (30S); and a cap (90, 90B) that is connected to a front end portion (61) of the metal shell (2, 2B), and that covers an opening of the metal shell (2, 2B) on the front end side to define an auxiliary combustion space (BS) in which the gap (G) is disposed, the cap (90, 90B) including at least one through hole (95*a*-95*d*) connecting the auxiliary combustion space (BS) and an outside, a first line (L1), a specific point (SP), a first tangent line (C1*a*-C1*d*), a second tangent line (C2*a*-C2*d*), and a second line (L2*a*-L2*d*) being defined in a section (CF1, CF2) including a center of gravity of an opening of a specific through hole (95*a*-95*d*) of the at least one through hole (95*a*-95*d*) on the auxiliary combustion space (BS) side, and the axis AX, the first line (L1) that passes through a center (MP) of a range which is perpendicular to the axis (AX), and in which the first discharge surface (20S) and the second discharge surface (30S) exist, and that is parallel to the axis (AX), the specific point (SP) being a middle point of a line (LS) connecting an intersection point (XP1) between the first line (L1) and the first discharge surface (20S), and an intersection point (XP2) between the first line (L1) and the second discharge surface (30S), the first tangent line (C1*a*-C1*d*) being a half line which extends from the specific point (SP), and which is tangent to the center electrode (20) on the specific through hole (95*a*-95*d*) side of the first line (L1), the second tangent line (C2*a*-C2*d*) being a half line which extends from the specific point (SP), and which is tangent to the ground electrode (30, 30B) on the specific through hole (95*a*-95*d*) side of the first line (L1), the second line (L2*a*-L2*d*) being a half line which extends toward the specific through hole (95*a*-95*d*) side of the first line (L1), and which is perpendicular to the axis (AX), a first angle (Aa-Ad) being formed by the second line (L2*a*-L2*d*) and the first tangent line (C1*a*-C1*d*), a second angle (Ba-Bd) being formed by the second line (L2*a*-L2*d*) and the second tangent line (C2*a*-C2*d*), the second angle (Ba-Bd) being greater than the first angle (Aa-Ad), and at least a portion of the opening (95*ao*-95*do*) of the specific through hole (95*a*-95*d*) on the auxiliary combustion space (BS) side being positioned on a range of the second angle (Ba-Bd).

By the above-described configuration, the second angle is greater than the first angle. Accordingly, the flame is easy to be discharged beyond the spark plug toward the front end side. Moreover, at least a portion of the opening of the specific through hole on the auxiliary combustion space side is positioned in the range of the second angle. Consequently, it is possible to suppress the interruption of the flame enlarged from the spark generated in the gap, and discharged from the specific through hole, by the ground electrode. Therefore, it is possible to decrease the heat loss and the pressure loss which are generated by the contact of the flame with the ground electrode. Accordingly, it is possible to improve the ignition performance of the spark plug.

In the spark plug according to the embodiment of the present invention, an entire of the specific through hole (95*a*-95*d*) is positioned in a range of a sum of the first angle (Aa-Ad) and the second angle (Ba-Bd).

By the above-described configuration, it is possible to effectively suppress the interruption of the flame discharged from the specific through hole by the ground electrode.

In the spark plug according to the embodiment of the present invention, the entire of the specific through hole (95*a*-95*d*) is positioned in the range of the second angle (Ba-Bd).

By the above-described configuration, the flame is further easy to be discharged beyond the ignition plug toward the front end side. Accordingly, it is possible to further improve the ignition performance of the ignition plug.

In the spark plug according to the embodiment of the present invention, the cap (90, 90B) includes a plurality of the specific through holes (95*a*-95*d*).

By the above-described configuration, the flame is discharged from the plurality of the specific through holes. Accordingly, it is possible to further improve the ignition performance of the spark plug.

The present invention is applicable to various devices. For example, the present invention is applicable to a spark plug, an ignition device using the spark plug, an internal combustion engine using the spark plug, and so on.

The entire contents of Japanese Patent Application No. 2018-158068 filed Aug. 27, 2018 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A spark plug comprising:

a center electrode extending in a direction of an axis, and including a first discharge surface;

an insulating member including an axial hole which extends in the direction of the axis, and which includes a front end portion to which the center electrode is disposed;

a metal shell which has a cylindrical shape, and which is disposed radially outside the insulating member;

a ground electrode including a second discharge surface which confronts the first discharge surface in the direction of the axis, and which forms a gap between the first discharge surface and the second discharge surface; and a cap that is connected to a front end portion of the metal shell, and that covers an opening of the metal shell on the front end side to define an auxiliary combustion space in which the gap is disposed, the cap including at least one through hole connecting the auxiliary combustion space and an outside, a first line, a specific point, a first tangent line, a second tangent line, and a second line being defined in a section including a center of gravity of an opening of a specific through hole of the at least one through hole on the auxiliary combustion space side, and the axis, the first line that passes through a center of a range which is perpendicular to the axis, and in which the first discharge surface and the second discharge surface exist, and that is parallel to the axis, the specific point being a middle point of a line connecting an intersection point between the first line and the first discharge surface, and an intersection point between the first line and the second discharge surface, the first tangent line being a half line which extends from the specific point, and which is tangent to the center electrode on the specific through hole side of the first line, the second tangent line being a half line which extends from the specific point, and which is tangent to the ground electrode on the specific through hole side of the first line, the second line being a half line which extends toward the specific through hole side of the first line, and which is perpendicular to the axis, a first angle being formed by the second line and the first tangent line, a second angle being formed by the second line and the second tangent line, the second angle being greater than the first angle, and at least a portion of the opening of the specific through hole on the auxiliary combustion space side being positioned on a range of the second angle.

2. The spark plug as claimed in claim 1, wherein in the section, an entire of the specific through hole is positioned in a range of a sum of the first angle and the second angle.

3. The spark plug as claimed in claim 2, wherein in the section, the entire of the specific through hole is positioned in the range of the second angle.

4. The spark plug as claimed in claim 1, wherein the cap includes a plurality of the specific through holes.

* * * * *